United States Patent [19]

Lanoue et al.

[11] Patent Number: 4,751,488

[45] Date of Patent: Jun. 14, 1988

[54] HIGH VOLTAGE CAPABILITY ELECTRICAL COILS INSULATED WITH MATERIALS CONTAINING $SF_6$ GAS

[75] Inventors: Thomas J. Lanoue, Muncie, Ind.; Clarence L. Zeise, Penn Township, Allegheny County, Pa.; Loren Wagenaar, Muncie, Ind.; Dean C. Westervelt, Acme, Pa.

[73] Assignee: The United States of America as represented by the United States Department of Energy, Washington, D.C.

[21] Appl. No.: 270,471

[22] Filed: Jun. 4, 1981

[51] Int. Cl.[4] ..... H01F 27/02

[52] U.S. Cl. ..... 336/84 R; 336/96; 264/102

[58] Field of Search ..... 336/94, 96, 232, 223

[56] References Cited

U.S. PATENT DOCUMENTS

| | | | |
|---|---|---|---|
| 2,893,061 | 7/1959 | Terry, Jr. | 264/102 |
| 3,240,848 | 3/1966 | Burke et al. | 264/102 |
| 3,652,471 | 3/1972 | Sattler | 260/22 R |
| 3,780,071 | 7/1973 | Eley | 336/84 |
| 4,039,990 | 8/1977 | Philp | 336/60 |
| 4,054,680 | 10/1977 | Sharbaugh | 427/13 |
| 4,160,178 | 7/1979 | Smith et al. | 310/43 |

FOREIGN PATENT DOCUMENTS 901242 7/1962 United Kingdom .

*Primary Examiner*—A. D. Pellinen
*Assistant Examiner*—Todd E. DeBoer
*Attorney, Agent, or Firm*—Robert J. Fisher; Judson R. Hightower

[57] ABSTRACT

A coil is made having a plurality of layers of adjacent metal conductor windings subject to voltage stress, where the windings have insulation therebetween containing a small number of minute disposed throughout its cross-section, where the voids are voids filled with $SF_6$ gas to substitute for air or other gaseous materials in from about 60% to about 95% of the cross-sectional void volume in the insulation, thus incorporating an amount of $SF_6$ gas in the cross-section of the insulation effective to substantially increase corona inception voltages.

11 Claims, 3 Drawing Sheets

HIGH VOLTAGE CAPABILITY ELECTRICAL COILS INSULATED WITH MATERIALS CONTAINING $SF_6$ GAS

GOVERNMENT CONTRACT

This invention was made or conceived in the course of or under Contract No. ET-78-R-01-3007, with the U.S. Government as represented by the U.S. Department of Energy.

BACKGROUND OF THE INVENTION

Insulation of electrical coils in a polymerizable resin, such as various epoxy or polyester formulations, is well known. During coil wrapping or encapsulation, inevitably and unavoidably, a small number of minute voids or pockets remain in the insulation after the resin has been cured to its solid state. These minute voids are usually filled with trapped air or solvent vapor. This problem was recognized by Burke, in U.S. Pat. No. 3,240,848. Burke pointed out that at points in an encapsulated electrical device where voltage differences were great, such as between a winding and a core or between primary and secondary windings, voids at pressures less than atmospheric were particularly objectionable.

Such minute voids reduce the withstand voltage of the electrical device and can become areas of corona discharges. These corona discharges can degrade the resin insulation chemically and electrically, leading to eventual catastrophic failure of the insulation. The corona inception voltage resulting from these minute voids follows Paschen's law, wherein the lower the gas pressure inside the voids, the lower the corona inception voltage will be. If the air gap is in series with a solid dielectric material, such as an insulating enamel, the partial discharge inception voltage of the total system will be somewhat greater than the inception voltage of the gap alone.

Burke attempted to solve some of the above described problems in transformers by homogeneously incorporating various gas release agents, such as cyclohexanoic dinitrile or azo isobutyric dinitrile, with resinous insulating materials, around coils or between winding layers. These agents were heat activated after the insulating resin was cure-advanced beyond the gel stage, to release and trap nitrogen gas in voids in communication with the agent, without expanding the void volumes. However, in this process, moisture laden air originally present in the resin cross-section would appear to remain, along with residual by-products of the release agents. Thus, the nitrogen gas evolved would probably occupy only about 30 to 40 vol.% of the total voids.

Sharbaugh, in U.S. Pat. No. 4,054,680, attempted to improve the corona inception voltage of a wide variety of electrical devices, such as capacitor rolls and sheet wound transformer coils. Sharbaugh evacuated air from the electrical device in a suitable pressure vessel, and admitted selected unsaturated monomeric gases, such as vinylidene fluoride, acrylonitrile, diethylvinylsilane, cyclohexane, styrene, toluene, xylene, and benzene, into the vessel at 24 psia., to fill the evacuated voids. A voltage was then applied across conductor layers of the device, to cause the gas to chemically polymerize as a solid, to fill and eliminate any voids in the device. This method, however, could provide shrinkage problems resulting in additional voids and internal stresses. In another process, Smith et al., in U.S. Pat. No. 4,160,178, taught contacting polyacrylic-epoxy resinous insulating material with a gaas selected from nitrogen, carbon dioxide, argon, helium methane, or hydrogen, to drive off dissolved, inhibiting-effective oxygen in the resin, to initiate an anaerobic cure mechanism without the application of heat.

While Burke and Sharbaugh are effective in various degrees to help improve corona inception voltages in an electrical device, a new and improved insulation system is needed to provide not only higher corona inception voltages, but also the ability to control and extinguish any corona initiated.

There is a need for an insulation system capable of being corona free, at voltages on the order of about 500 to 1,500 volts/turn, for use in a variety of extemely sophisticated high voltage devices, such as tank enclosed, gas insulated, shunt reactors of the 1,200 kV range. These reactors may require up to 7 ft. diameter wound coils, having the characteristic of extremely high turn-to-turn voltages. In such devices and in other insulated high voltage systems, insulation with voids containing nitrogen gas is not particularly effective to provide a high level of corona extinction or corona free operation.

SUMMARY OF THE INVENTION

The above problems have been solved, and the above need met, by providing a plurality of adjacent metal conductors having insulation disposed therebetween, where the insulation contains minute voids filled with sulfur hexafluoride ($SF_6$) gas. In preferred embodiments, the conductors will be aluminum or copper foil windings, and the insulation will comprise a layered system, with the layer next to the foil consisting essentially of an oil-modified polyester enamel. The prime use of this insulation system will be in a completely encapsulated coil or a coil operating $SF_6$ gas.

A variety of methods can be utilized to produce such coils. In a first method, enameled foil is first wound on a cylinder while submersed in an enclosed bath containing liquid resin insulation blanketed with $SF_6$ gas, then the coil winding is removed from the enclosed resin bath and heat cured while in an $SF_6$ gas environment. In a second method, foil, which may optionally be enameled, and a porous sheet are wound on a cylinder, the winding is removed from the cylinder and placed in a suitable pressure vessel where air is evacuated and $SF_6$ gas is admitted under pressure, the $SF_6$ gas is evacuated and liquid resin insulation is admitted under pressure to impregnate the porous sheet, after which the foil winding is heat cured while in an $SF_6$ gas environment.

Additional methods include a third method, where enameled foil is wound onto a cylinder, starting at the bottom surface of the cylinder, while liquid resin insulation is fed into the trough formed between the foil and the bottom of the cylinder, all of this preferably being done in an $SF_6$ gas environment, to provide a further insulation between the foils. The winding is then removed from the cylinder and heat cured while in an $SF_6$ gas environment. In a fourth method, foil, which may optionally be enameled, having "B-staged" insulating resin adhesive thereon, is wound on a cylinder in the presence of air. The foil wound coil is then subjected to a pressure differential through its cross section while in the presence of $SF_6$ gas, thereby forcing $SF_6$ gas into the coil, followed by heat curing in an $SF_6$ gas environment.

These methods can be modified in various degrees, for example, in the first three methods, $SF_6$ gas may be forced into the coil by establishing a pressure differential through the coil cross section in the presence of $SF_6$ gas prior to heat cure. In the fourth method, a porous sheet can be inserted between enameled adhesive coated foil, said sheet being impregnated with a liquid resin insulation in a separate step.

Coils wound by the methods described above have $SF_6$ gas physically displacing air in minute voids present in the insulation between adjacent turns of windings. Coils having from 2 to 5,000 winding layers can be made by these methods, with such coils exhibiting corona extinction voltages on the order of about 500 to 1,500 volts/turn, where the insulated distance between turns is about 1.5 mil. The use of $SF_6$ in the minute voids can allow use of thinner insulation between windings, and still provide a high level of corona extinction.

BRIEF DESCRIPTION OF THE DRAWINGS

For a better understanding of the invention, reference may be made to the exemplary embodiments shown in the accompanying Drawings, in which.

DESCRIPTION OF THE PREFERRED EMBODIMENTS

Figure 1:
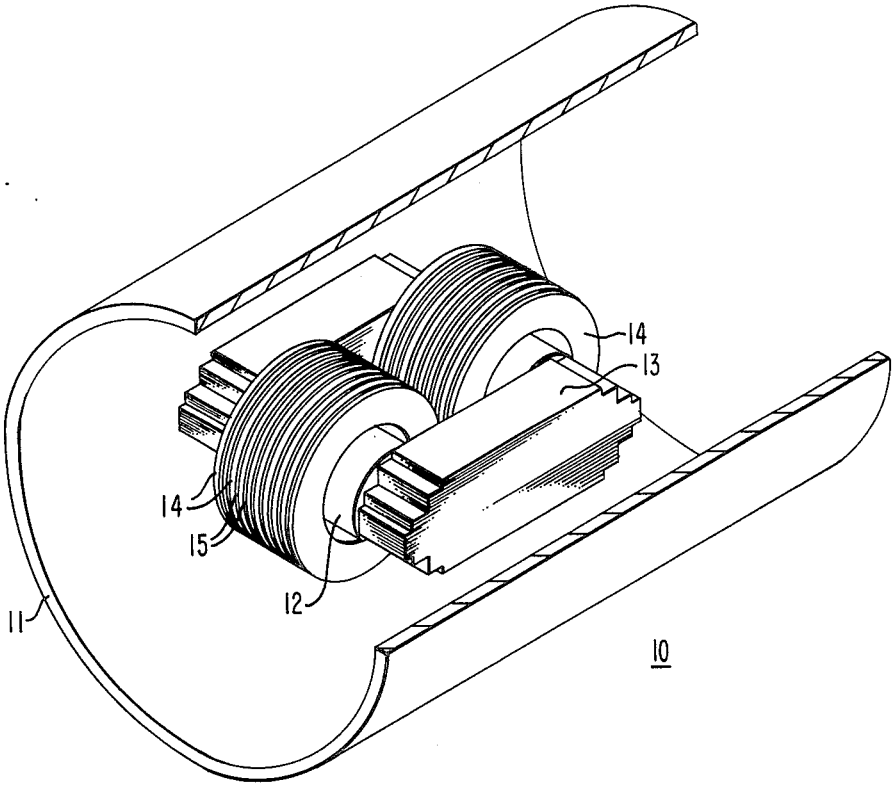
FIG. 1 is an isometric view, partially in section, of a high voltage shunt reactor, utilizing coils made in accordance with this invention, enclosed in an atmosphere of $SF_6$ gas.

Referring to FIG. 1 of the Drawings, one embodiment of a shunt reactor 10 is shown. A shunt reactor is a reactor intended for connection in shunt to an electrical system for the purpose of drawing inductive current. The normal use for shunt reactors is to compensate for capacitive current effects from transmission lines, cable, or capacitors. The shunt reactor shown comprises a housing 11, for enclosing the reactor in an $SF_6$ insulating gas environment, and molded microlaminate, high reluctance cores 12, attached at each end to a high permeability electrical steel yoke 13, and each disposed within a series of thin coils 14. Winding cooling ducts 15 are shown between coils 14. This double winding reactor design can have a rating as high as 1,200 kV across coils having 1,000 to 2,400 turns of insulated foil each. At such high stresses, corona leading to eventual complete breakdown of the insulation can occur. In these double winding reactors, each coil 14 may have an inside diameter of about 4 feet, an outside diameter of up to 7 feet, and a thickness of about 1½ to 3 inches or more.

Figure 2:
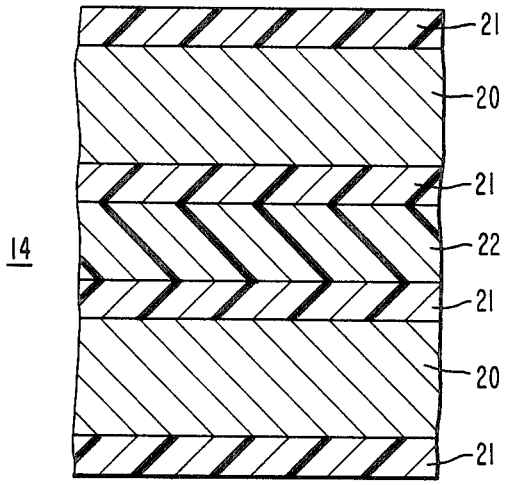
FIG. 2 is a cross section of two layers of insulated coil.

Generally, each of the coils 14 comprise a plurality of layers or turns of electrically conducting windings 20, such as about 2 mil to 10 mil (0.002 inch to 0.010 inch) thick aluminum or copper foil, with insulation therebetween, as shown in FIG. 2 of the Drawings. This insulation system may preferably comprise a layer of high grade oil-modified polyester enamel 21, which may be about 0.5 mil to 2.5 mil thick, directly coating both sides of the windings, with an additional insulation layer 22, such as epoxy or polyester, therebetween. Epoxy coatings may in some instances be substituted for the polyester enamel. Also, in some cases the conductors may be bare, where insulation layer 22 is the only insulation between the conductors. The additional insulation layer 22 can be between about 0.1 mil to 3.0 mil thick, depending on whether it is used as a resin alone, or is impregnated into a porous sheet material. The insulation layer 22 also functions as an adhesive, to bond adjacent coil windings together. The additional insulation layer may, in some instances, be eliminated.

Figure 3:
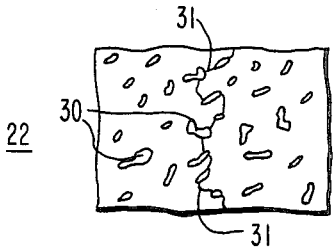
FIG. 3 is an exaggerated microscopic cross section of coil insulation showing the multiplicity of gas filled voids therein.

Referring to FIG. 3 of the Drawings, an exaggerated microscopic cross-section of insulation layer 22 shows voids or pockets 30 uniformly disposed throughout the insulation. These voids, herein defined to be nonresin containing pockets, are necessarily present in the insulation and are impossible to avoid during application and cure of the insulation, and would usually be filled with air, where insulation and coil winding is conducted in air. As can be seen, many of the voids may be interconnecting, and under high voltage, stress concentration in the lower dielectric constant gaseous material will provide localized corona ionization sites and tracking paths 31 through the insulation, with resultant insulation degradation and possible shorting. Of course, the voids are minute and comprise only a small volume percent of the total insulation. Their size in the figure has been greatly exaggerated for the purposes of illustration of the tracking path. Such voids would also be present to a lesser extent in insulaton layer 21.

In the broadest aspect of this invention, the voids in insulating layers disposed between a plurality of electrical conductors under a high voltage stress are filled with $SF_6$ gas. Sulfur hexafluoride is a unique material. It is a gas at room temperature and atmospheric pressure, and it is chemically inactive. It is odorless, non-combustible, and has a low toxicity. We have found that it has a dielectric strength substantially higher than that of air or nitrogen, so that an electric arc therein not only tends to be smaller, i.e., more filamentary, but also to decay and be extinguished substantially more rapidly.

In this invention, $SF_6$ gas will be substituted for air or other gaseous materials in from about 60% to about 95% of the void volume in the insulation, thus incorporating an amount of $SF_6$ gas effective to substantially increase corona inception voltages, and provide a high level of corona extinction between the conductors. The use of $SF_6$ gas to fill such insulation voids is not limited to shunt reactors, but can also find application in potential and current transformers, power transformers, distribution transformers, and the like. The preferred embodiment, set forth hereinbelow, and relating to shunt reactor coils, is not to be taken as limiting the scope of the invention in any way.

The method of this invention broadly involves coating a metal conductor, usually about 2 to 10 mil thick, 1½ to 3 inch wide aluminum or copper foil, with at least one layer of an insulating resinous material having minute voids therein, and winding the insulated metal foil around a mandrel, to provide a coil having a plurality of conductor layers, each insulated from the other by the insulating material, where minute voids contained in the insulating material are evacuated or otherwise removed of air and filled with $SF_6$ gas. The insulating material will preferably comprise a first layer contacting the foil, and a second layer disposed therebetween. The first layer will preferably comprise a 0.5 to 2.0 mil thick coating of high electrical grade enamel, such as, for example, an amide-imide-ester, described in U.S. Pat. Nos. 3,555,113 and 3,652,471, or preferably, an oil-modified polyester, such as that described in U.S. Pat No. 3,389,015, all herein incorporated by reference. The second layer, which serves as an interior coil adhesive as well as insulation, will preferably comprise epoxy or polyester resin applied as a liquid or a "B-staged" adhesive, alone, or impregnated into or coated onto a porous sheet material selected from polyester, polyamide or cellulosic sheet about 1 to 3 mils thick. This second layer can be quite thin, i.e., about 0.1 mil when a resin is used alone without a porous sheet. In order to fill voids in the insulation with $SF_6$ gas, air can be evacuated or otherwise removed, and $SF_6$ gas can be introduced into the voids, or the coil can be wound in an $SF_6$ gas environment. A more detailed description of the various methods to make the coils of this invention follows.

Figure 4:
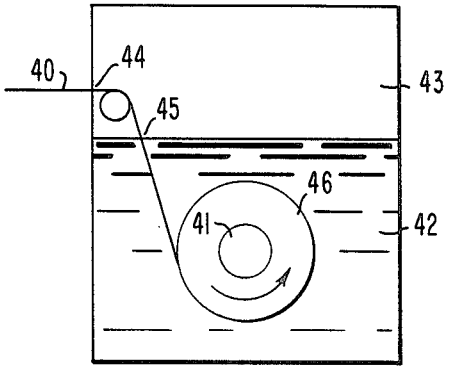
FIG. 4 is a diagram of a first method of making coils.

In a first method, enameled metal foil 40 is wound around a rotating cylinder 41 which is submersed in an enclosed bath containing air degassed liquid insulating resin 42 selected from epoxy and polyester resin, as shown in FIG. 4 of the Drawings. The liquid resin will preferably have a viscosity of between about 5 cps. and 10,000 cps., at 25° C. Such resins are well known in the art and are commercially available. The enclosed bath is blanketed with $SF_6$ gas 43. Here, as the enameled metal foil enters the $SF_6$ gas atmosphere above the enclosed bath, its contact with $SF_6$ gas at point 44 initially removes air on its surface, and introduces $SF_6$ gas into insulating voids. Its entry into the liquid resin bath at point 45 additionally helps remove air from the foil surface. During this winding step, a thin layer of liquid insulating resin is provided between enamel layers of adjacent coil windings. The coil winding 46 is then removed from the resin bath and heated in an oven maintained in a pressurized $SF_6$ gas environment, at a temperature and for a time effective to cure the insulating resin to a thermoset state. This will result in a wound coil with a large percentage of the voids in the insulation containing $SF_6$ gas rather than air. This method should have the best coil consolidation and be the most reliable in eliminating air from the insulation voids of those described herein and shown in the Drawing.

Figure 5:
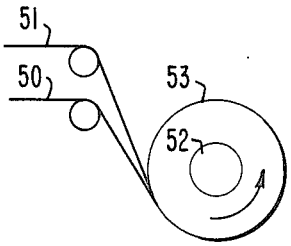
FIG. 5 is a diagram of a second method of making coils.

In a second method, metal foil 50, which may optionally be enameled, and a polyester, polyamide, or cellulosic or other suitable porous interleaf sheet 51 are contacted and wound on a rotating cylinder 52 in air, as shown in FIG. 5 of the Drawings. The coil winding 53 is placed in a suitable pressure vessel where air and moisture are evacuated, and $SF_6$ is then admitted under a pressure of about 20 psi. to 60 psi. The $SF_6$ gas is then evacuated and liquid impregnating resin is admitted under a pressure of about 20 psi. to 60 psi. to impregnate the porous sheet. The impregnated coil winding is then removed from the vacuum impregnation apparatus and heated in an oven maintained in an $SF_6$ gas environment, at a temperature and for at time effective to cure the insulating resin. This will result in a wound coil with a large percentage of the voids in the insulation containing $SF_6$ gas rather than air.

Figure 6:
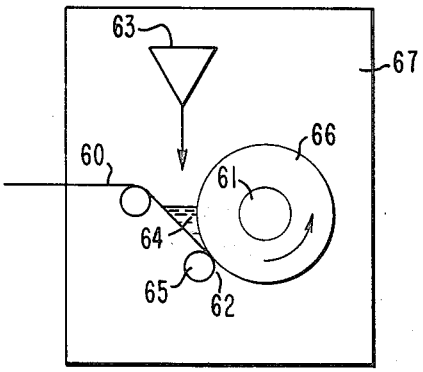
FIG. 6 is a diagram of a third method of making coils.

In a third method, enameled metal foil 60 is wound onto a rotating cylinder 61, preferably in the presence of $SF_6$ gas 67, starting at the bottom surface 62 of the cylinder, while liquid insulating resin 63 is fed into the trough 64 formed between the foil, the bottom of the cylinder, and the pressure roll 65, as shown in FIG. 6 of the Drawings. During this winding step, a thin layer of liquid insulating resin is provided between enamel layers of adjacent coil windings. The coil winding 66 is then removed from the resin bath and heated in an oven maintained in an $SF_6$ gas environment, at a temperature and for a time effective to cure the insulating resin. This also will result in a wound coil with a large percentage of the voids in the insulation containing $SF_6$ gas rather than air.

Figure 7:
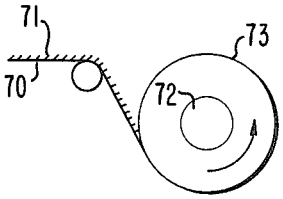
FIG. 7 is a diagram of a fourth method of making coils.

In a fourth method, metal foil 70, which must be enameled or otherwise insulated, is coated with a layer of liquid insulating resin 71 which is dried to the "B-stage", i.e., nontacky and dry to the touch yet capable of cure to an infusible solid state, and then wound on a rotating cylinder 72 in the presence of air, as shown in FIG. 7 of the Drawings. The wound coil 73 is then placed in a suitable pressure vessel, where air is evacuated and $SF_6$ gas admitted. The wound coil is then subjected to a pressure differential of between about 2 psi. to about 60 psi. through its cross section while in the presence of $SF_6$ gas. This step requires a support wall and pressure divider across the circumferential area of the pressure vessel to hold the coil in place. This step forces $SF_6$ gas into the coil and air out. Following this step, the coil winding is removed from the pressure vessel and heated in an oven maintained in an $SF_6$ gas environment, at a temperature and for a time effective to cure the insulating resin. This will also result in a wound coil with a large percentage of the voids in the insulation containing $SF_6$ gas rather than air.

Various obvious modifications of all of these methods are of course possible and considered within the scope of the invention. For example the use of a pressure differential through the cross section of the coil while in the presence of $SF_6$ gas as described in the fourth method, is a particularly effective means to assure $SF_6$ gas penetration and can be useful in all the methods described above. In all of these methods, the finished completely cured coils must be either stored in an $SF_6$ environment or quickly assembled into an electrical apparatus, as the $SF_6$ will slowly diffuse into an air environment over a 48 hour period.

EXAMPLE 1

Two sets of coils were made in a fashion similar to that shown in FIG. 6 of the Drawings, except that the coils were wound in air. Set (A) had a 0.7 mil build of enamel and Set (B) had a 1.0 mil build of enamel on each side of the foil conductor. Aluminum foil 3 inches wide by 5 mil (0.005 inch) thick, having a cured 0.7 mil build coating (Sample A) and a 1.0 mil build coating (Sample B) of oil-modified polyester enamel insulation on each side, was fed to the bottom surface of a motor driven lathe winding mandrel cylinder. The mandrel cylinder was about 5 inches long by 2½ inches in diameter and had a first covering of a Teflon interleaf. At the point of contact of the enameled foil with the winding cylinder and the pressure roll, a trough was formed. A low molecular weight, solventless, catalyzed diglycidyl ether of bisphenol A epoxy resin, having an epoxy equivalent weight of about 190 and a viscosity at 25° C. of about 900 cps., was poured into the trough, from a reservoir fitted with an outlet valve, as the cylinder turning was started. Epoxy resin was added in an amount slightly above the use rate so as to keep a continuous bead of resin across the trough.

The cylinder was turning and pulling at a rate of about 20 rpm and provided a tension on the foil of about 10 pounds per width of foil. Excess resin was caught in a collecting pan. The epoxy resin provided a very thin adhesive layer between enamel surfaces of adjacent coil windings. After 29 turns the resin feed and cylinder were stopped, the foil was cut, and the cut was secured by banding it to the coil.

Sample (A) and Sample (B) coils were then heated in an oven at 165° C. for about 6 hours to cure the epoxy. The Sample (A) and Sample (B) coils were then cut parallel to their axis to remove a 40° segment of their circumference, providing 320° split coils for testing. The epoxy adhesive layer between enamel layers was measured at about 0.2 mil. Thus the total insulation thickness between adjacent foils was about 1.6 mil for Sample (A) and about 2.2 mil for Sample (B). The exposed coil ends were then etched in a solution of hydrochloric acid and then rinsed and dried. Electrodes were then attached across the top and bottom windings and the ends finally coated with two layers about 0.5 mil each of oil-modified polyester, with heating to cure after each build.

Sample (A) and Sample (B) coils were then tested in a vacuum-pressure vessel. The coils were placed in the pressure vessel and air was evacuated. For the first lot of Sample (A) and (B) coils the vessel was then filled with $N_2$ gas at 46 psig. For additional Sample (A) and (B) coils, the vessel was filled with $SF_6$ gas at 49 psig. In both cases, the gases were passed through a filter to remove dust and moisture. A voltage was then applied across the 29 coil turns, and corona extinction voltages measured after each sample had been in its respective pressurized gas environment for about ½ hour. The averaged results are shown in Table 1 below:

TABLE 1

| | Total Insulation Between Turns | Average Corona Extinction Voltage/Turn | |
|---|---|---|---|
| | | 46 psig $N_2$ | 49 psig $SF_6$ |
| Sample A | 1.6 mil | 447 volts | 502 volts |
| Sample B | 2.2 mil | 540 volts | 690 volts |

As can be seen, $N_2$ gas, which is known in the art as useful in lowering discharge inception voltages as compared to air systems, achieved 500 volts/turn only with a 2.2 mil total insulation build between turns, whereas substitution of $SF_6$ for air insulation voids achieved slightly over 500 volts/turn values with only 1.6 mil total insulation build. At 2.2 mil build, the substitution of $SF_6$ for air appears even more dramatic over $N_2$, showing an increase of 150 volt/turn or about a 28% advantage. This illustrates the superiority of $SF_6$ as a substitution for air, and its non-equivalency for either air or nitrogen in this area. The method used for these samples provides a smaller amount of $SF_6$ inclusion than any of the other methods described hereinabove and serves to show their potential. For example, if the method of FIG. 4 of the Drawings were used, it is expected that values would be 1.5 to 2 times greater than those of the $SF_6$ exposed samples above, where $SF_6$ inclusion was concentrated at the edges of the samples. The results also show that less insulation thickness is needed to achieve a particular corona extinction voltage/turn rating utilizing $SF_6$ in insulation voids, which could lead to a tremendous cost and weight savings.

EXAMPLE 2

In another example, two 10 mil thick aluminum foils, both coated with a 1.5 mil thick build (0.75 mil thickness on each side of the foil) of oil-modified polyester enamel insulation, were placed together such that one edge of each foil was aligned one with another, and the other three edges were flared away from the other foil so as not to create excessive electric fields in these regions. The sample was placed in a vacuum-pressure vessel, evacuated for 0.5 hour and then the vessel was filled with $N_2$ gas at 45 psig. The sample was then corona tested.

In the second part of the test, another sample was placed in the vacuum pressure vessel. The vessel, was then evacuated again for 0.5 hour after which it was filled with $SF_6$ at 45 psig. The sample was then corona tested. Results of the corona tests showed 940 volts extinction while the sample was in nitrogen and 1,500 volts extinction while the sample was in $SF_6$. This shows that on this sample, $SF_6$ was about 60% better than nitrogen at the same pressure where the total insulation between conductors was 1.5 mil.

We claim:

1. A plurality of adjacent metal conductors subject to voltage stress therebetween, said conductors having at least one layer of cured resin insulation therebetween, each layer of said cured resin insulation having been applied as a liquid resin and necessarily containing minute voids therein disposed throughout its cross-section and constituting a small volume percent of the resin insulation; a large percentage of said voids within layer cross-sections being filled with $SF_6$ gas to displace air before substantial resin cure, said $SF_6$ gas being present in said voids in an amount effective to provide a high level of corona extinction between the adjacent conductors.

2. The insulated adjacent metal conductors of claim 1 being subject to voltage stress therebetween, where $SF_6$ gas is present in from about 60% to about 95% of the cross-sectional void volume in the insulation.

3. The insulated adjacent metal conductors of claim 1, where the conductors are selected from the group consisting of aluminum and copper, the conductors are coated with a cured enamel insulation layer selected from the group consisting of cured amide-imide-ester resin and cured oil-modified polyester resin, and adjacent enamel coated conductors have an additional cured insulation layer therebetween selected from the group consisting of cured epoxy resin and cured polyester resin.

4. A coil comprising a plurality of layers of adjacent metal conductor windings subject to voltage stress therebetween, said windings having at least one layer of cured resin insulation therebetween, each layer of said cured resin insulation having been applied as a liquid resin and necessarily containing minute voids therein disposed throughout its cross-section and constituting a small volume percent of the resin insulation; voids within layer cross-sections being filled with $SF_6$ gas to displace air before substantial resin cure, said $SF_6$ gas being present in said voids in an amount effective to provide a high level of corona extinction between the conductors.

5. The coil of claim 4, where the insulation is capable of corona extinction voltages of at least about 500 volts between adjacent conductors, when the insulation thickness between conductors is about 1.5 mil.

6. The coil of claim 4, in an electrical apparatus.

7. The coil of claim 4, in an electrical apparatus, said coil being disposed in an enclosed $SF_6$ gas environment.

8. The coil of claim 4, in a high voltage shunt reactor, said coil being disposed in an enclosed $SF_6$ gas environment.

9. The coil of claim 2, where the conductors are selected from the group consisting of aluminum and copper, the conductors are coated with a cured enamel insulation layer selected from the group consisting of cured amide-imide-ester resin and cured oil-modified polyester resin, and adjacent enamel coated conductors have an additional cured insulation layer therebetween selected from the group consisting of cured epoxy resin and cured polyester resin.

10. The coil of claim 9 where the metal conductors are metal foils about 2 mil to about 10 mil thick, the enamel insulation on each side of the foil is up to about 2.0 mil thick, and the additional insulation between the conductors is up to about 3.0 mil thick.

11. The coil of claim 9, where $SF_6$ gas is present in from about 60% to about 95% of the cross-sectional void volume in the insulation.

* * * * *